United States Patent [19]

Schoonover

[11] Patent Number: 5,012,531

[45] Date of Patent: May 7, 1991

[54] FORM RETAINING HOLDER FOR VISORED CAP

[76] Inventor: Richard L. Schoonover, 181 Lake Terrace Dr., Munroe Falls, Ohio 44262

[21] Appl. No.: 514,661

[22] Filed: Apr. 25, 1990

[51] Int. Cl.[5] ..... A42C 5/00

[52] U.S. Cl. ..... 2/185 B; 2/46; 206/8

[58] Field of Search ..... 2/46, 185 B, 185 C, 2/185 R, 187, 199, 209.1; 206/8

[56] References Cited

U.S. PATENT DOCUMENTS

| | | | |
|---|---|---|---|
| 870,550 | 11/1907 | Dod | 206/8 |
| 1,138,414 | 5/1915 | Randolph | 206/8 |
| 1,582,102 | 4/1926 | Tuten | 206/8 |
| 2,259,930 | 10/1941 | Gawelek | 206/8 |
| 2,586,700 | 2/1952 | Noble | 206/8 |
| 2,655,256 | 10/1953 | Guest | 2/46 |
| 2,659,481 | 11/1953 | Jones | 2/46 |
| 2,677,457 | 5/1954 | Guest | 2/46 |
| 4,637,077 | 1/1987 | Henschel | 2/185 B |
| 4,858,247 | 8/1989 | Hooser | 2/185 B |

*Primary Examiner*—Werner H. Schroeder
*Assistant Examiner*—Diana Biefeld
*Attorney, Agent, or Firm*—Oldham & Oldham Co.

[57] ABSTRACT

A form retaining holder or case for a visored cap comprises an upper shell and a lower shell, both shell portions sized and adapted to accommodate a visored type cap, such as used in the game of baseball, when the back portion of the cap is folded forwardly into the interior of the front portion of the cap. In such a holder, the cap is interposed between the upper shell and lower shell so that the form of the cap is retained during carriage and storage, and some modicum of protection for the cap is provided. The upper shell and lower shell are connected by means of known fastening means and by a lip disposed on the lower surface of the visor portion of the upper shell, such lip adapted to engage the visor of lower shell therein. Ventilation holes may be provided both upper and lower shell portions, particularly in portions adjacent to the periphery of the crown portion of the cap where it closely accommodates the wearer's head.

16 Claims, 3 Drawing Sheets

FIG.-3A
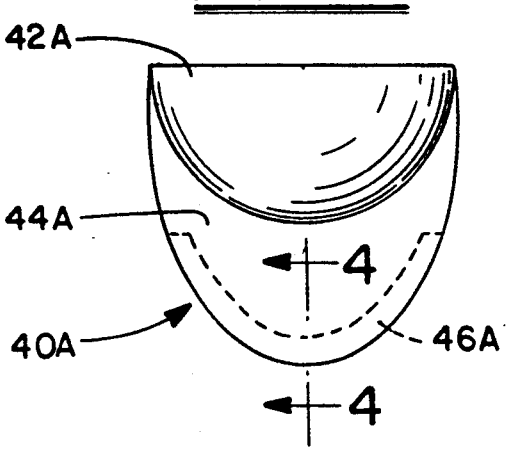
FIG.-3B
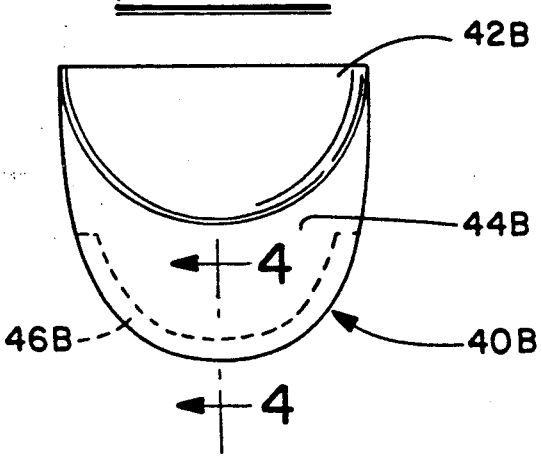
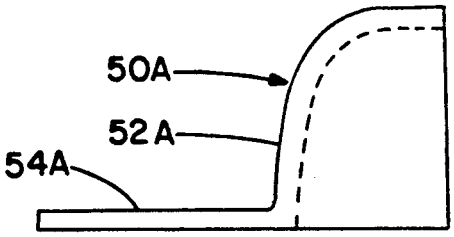
FIG.-5A
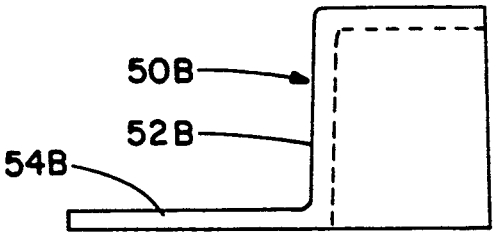
FIG.-5B
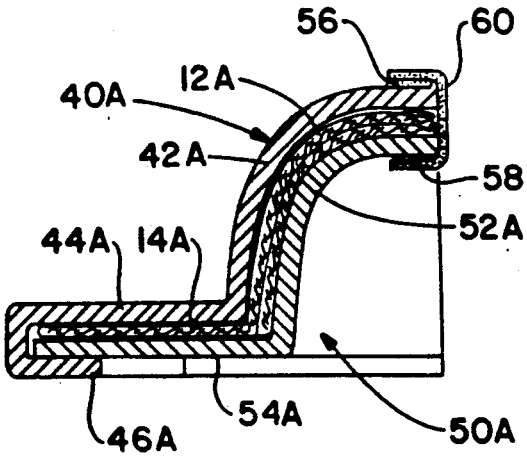
FIG.-6A
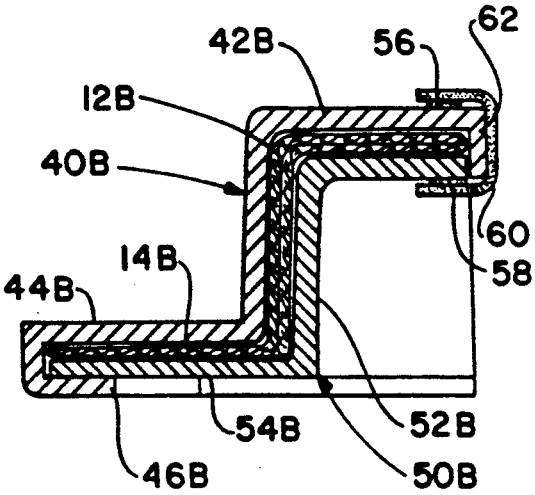
FIG.-6B

FORM RETAINING HOLDER FOR VISORED CAP

TECHNICAL FIELD OF THE INVENTION

This invention relates to a form retaining holder or case for a visored cap, particularly one such as a baseball cap or the like. More specifically, the present invention relates to a two piece holder for retaining the shape of such a visored cap and providing some protection for it from the elements. Even more specifically, the present invention relates to a two piece holder for a visored cap, said holder having a plurality of ventilation holes disposed therein for permitting air circulation to said visored cap.

BACKGROUND OF THE INVENTION

A distinctive part of the game of baseball is the uniform worn by the participants. A very distinctive part of that uniform includes a visored cap, which has a very familiar design. Such caps generally consist of a crown portion sized to accommodate the head of the wearer and a stiff brim in the form of a visor that can shade the eyes. The crown portion of the cap is generally constructed in one of two manners.

The first, and more common, manner of constructing a baseball cap is to stitch together from about four to about six basically triangular shaped sections so that the apex of each triangle meets in the center of the crown. These triangles are slightly tapered so that the completed assembly forms a concave crown. Typically, the apex of the crown portion of such a cap has a cloth-covered button attached thereto. The various triangular shaped sections can be of one single color or a plurality of colors, and the cloth covering the apex button may be a matching or contrasting color.

A second manner of constructing the crown of a baseball cap is to have a "pillbox" shape, that is, the crown portion is comprised of a rounded and generally vertical plane of material topped by a generally circular shaped piece of material, this generally circular piece of material being positioned on the generally vertical piece of material in a substantially perpendicular manner. This latter form of crown for a baseball cap was popular in the late 1800's and has enjoyed some renewed popularity in recent years with some baseball clubs, for example, with the Pittsburgh Pirates baseball club.

Regardless of the variation in the crown structure, the visor portion of the cap is generally a stiff brim, covered with a cloth material, that is positioned forwardly on the cap as the cap is worn upon the head. The periphery of the crown portion of the cap generally has a headband-type liner to it. It is this portion of the cap that is in the most intimate contact with the wearer and it is this portion of the cap and the visor that are most likely to absorb moisture from the wearer's perspiration as the cap is worn.

Although the visor of the cap is generally stiff, due to the material such as cardboard which is used to underly the cloth covering, the visor may be deformed by the wearer. A radical deformation of the visor could result in a permanent distortion of the cap shape.

Baseball caps are generally fabricated from cloth material and the quality of the cloth clearly increases as the quality of the hat increases, so that at the advanced levels of the game, particularly the major leagues, the caps are rather expensive. At all levels of the game, the players are expected to maintain their cap during the entire season. This will entail a large number of games played in some amount of precipitation, exposure to dust and dirt, and handling by hands soiled with pine tar, rosin, and, perhaps, even some of the variety of substances allegedly used by some pitchers to obtain the infamous effects of the pitch known as the "spitball." It is also noted that certain baseball players are known for practical jokes such as pouring cups of liquid over the heads of their colleagues.

The interior of the crown portion of the cap is generally devoid of stiffening or reinforcing material, although such reinforcing material is occasionally used on the crown portion of the cap adjacent to the visor portion, where a team logo or other design is embroidered or otherwise secured to the crown portion of the cap.

Just as the fabric of construction for the caps will vary with the cost of the cap, so too does the size variability on the caps. Specifically, the less expensive baseball caps, many of which are comprised of a relatively open mesh synthetic material, have an adjustable band means disposed around the periphery of the crown and fastening to itself at the rear of the crown portion of the hat so that one size can be adjusted to fit essentially all users. In the more expensive caps, the cap is formed to a particular cap size and, although there may be a slight amount of elastic material to secure the cap on the head of the wearer, there is very little adjustability of the cap size.

At least one U.S. Pat. No. 4,858,247 to Hooser, describes a form retaining support that is designed to be removably positioned within a baseball cap that has been recently laundered. This support is intended to maintain the desired cap shape while the particular cap dries. Although this type of cap shape support appears to be useful after the cap has been laundered or dry cleaned, it does not appear to have the required rigidity to permit such a cap to be stored with other baseball equipment, that is, gloves, shoes, uniform and the like in an equipment bag. Nor does the cap shape support of Hooser provide any support for the visor of the cap. Also, the invention of Hooser does not provide any protection of the cap from accidental spills, dirt, etc., since the support shape is fitted entirely inside the cap.

SUMMARY OF THE INVENTION

A first object of the present invention is to provide a form retaining support for maintaining the shape of a visored cap, such as a baseball cap, after a game, during which time the cap may become damp from the wearer's perspiration, precipitation, and other sources.

A second object of the present invention is to provide a relatively rigid holder to maintain the shape of a baseball cap or the like while generally encasing it in a rigid material that will allow the baseball cap to be placed in an equipment bag with other baseball equipment.

A third object of the invention is to provide a means for encasing a baseball cap or the like and to still permit ventilation of the cap to permit drying and prevent mildew.

These and further objects of the invention are achieved by a protective case for a cap having a crown portion with front and rear halves, and a visor portion affixed to the front half of the crown portion, the rear half of the crown portion being inwardly foldable to be proximate to the front half, thereby forming first and second surfaces in such folded position, said protective case comprising: a first shell member having a visor portion and a crown portion and first and second surfaces, said first shell member having its second surface sized and adapted to be slightly larger than, and to closely accommodate, the first surface of said cap when the crown portion of said cap is in said folded position; a second shell member having a visor portion and crown portion and first and second surfaces, said second shell member having its first surface sized and adapted to be slightly smaller than, and to closely accomodate, the second surface of said cap when the crown portion of said cap is in said folded position; at least one means for engaging the visor portion of said first shell member with the visor portion of said second shell member while the visor portion of said cap is juxtaposed between said the visor portions of said first and second shell members; and at least one means for fastening the crown portion of said first shell member to the crown portion of said second shell member when the crown portion of said cap is juxtaposed between the crown portions of said first and second shell members.

Further of these objectives are obtained by a protective case wherein the crown portions of respective first and second shell members are shaped to accomodate a cap having a generally dome-shaped crown portion or a generally pillbox-shaped crown portion.

These objectives are also obtained by a protective cap wherein the means for engaging the respective visor portions of the shell members comprises a lip portion disposed on one surface of one said shell member, said lip portion providing a slot for inserting the visor portion of the other said shell member.

These objectives are also obtained by a protective case wherein the means for fastening the crown portion of one shell member to the crown portion of other shell member comprises: an elongated strip; and an engaging means having first and second components, the first and second components being non-permanently attachable to the other; one such component affixed to each end portion of said strip and two corresponding components, one each affixed to the first surface of the first shell member and the second surface of the second shell member. In particular, corresponding hook and loop materials can serve as such first and second components. An alternate means for fastening the crown portion of one shell member to the crown portion of the other shell member comprises a hinge having first and second ends, the ends of said hinge affixed to the crown portion of the corresponding shell members.

These objectives are obtained by a protective case constructed of a sufficient thickess of a plastic material to be structurally rigid, particularly moldable polyurethane, moldable polypropylene, or moldable polycarbonate.

These objectives are obtained by a protective case further having a plurality of ventilation holes in said first and second shell members, particularly when the holes are concentrated near the area of the respective shell members where the visor portion is attached to the crown portion. The holes can be circular or generally elongated slots.

These and even further objects of the invention will be illustrated in the detailed description of the invention and the drawings which are presented herewith.

BRIEF DESCRIPTION OF THE DRAWINGS

The invention will be better understood when reference is had to the following drawings, wherein:

FIG. 3A shows a top view of the upper shell of the present invention, as adapted for use with a common "dome"-type baseball cap;

FIG. 3B shows a top view of the upper shell of the present invention, adapted for use with the "pillbox"-type baseball cap;

FIG. 5A shows the lower shell of the present invention, as adapted for use with the common "dome"-type baseball cap;

FIG. 5B shows the lower shell of the present invention, as adapted for use with the "pillbox"-type baseball cap;

FIG. 6A shows a cross-sectional view of the upper and lower shells of the present invention in operative engagement with a "dome"-type baseball cap;

FIG. 6B shows a cross-sectional view of the upper and lower shells of the present invention, in operative engagement with the "pillbox"-type baseball cap;

ABSTRACT OF THE DRAWINGS

In the enclosed description of the drawings and in the accompanying drawings, the following numbers are used to indicate the following parts:

10A is the visored cap of the prior art, having the dome-shaped crown portion;

10B is the visored cap of the prior art, having the pillbox-shaped crown portion;

12A is the crown portion of the dome-shaped cap 10A of the prior art;

12B is the crown portion of the pillbox-shaped cap 10B of the prior art;

14A is the visor of the dome-shaped cap 10A of the prior art;

14B is the visor of the pillbox-shaped cap 10B of the prior art;

16A is the headband portion of the dome-shaped cap 10A of the prior art;

16B is the headband portion of the pillbox-shaped cap 10B of the prior art;

18 are the triangular sections of the crown shaped cap 10A of the prior art;

19 is a cloth-covered button;

20 is the vertical portion of the pillbox-shaped, cap 10B of the prior art;

22 is the horizontal portion of the pillbox-shaped cap 10B of the prior art;

40A and 40B are the upper shell portions of the present invention, adapted for use with caps 10A and 10B, respectively;

42A and 42B are the crown portions of the upper shell, 40A or 40B, of the present invention, as adapted to accommodate caps 10A or 10B respectively;

44A and 44B are the visor portions of the upper shell, 40A or 40B, of the present invention, adapted to accommodate caps 10A or 10B respectively;

46A or 46B is the lip of the visor portion, 44A or 44B, of the upper shell of the present invention, adapted for fitting caps of type 10A or 10B respectively;

48 is the engagement slot for the upper shell 40A or 40B of the present invention;

50A and 50B are the lower shell of the present invention, adapted to accommodate cap 10A or 10B respectively;

52A and 52B are the crown portions of the lower shell, 50A or 50B, of the present invention, adapted to fit caps 10A or 10B respectively;

54A and 54B are the visor portions of the lower shell, 50A or 50B, of the present invention, adapted to fit cap 10A or 10B respectively;

56 is a fastening means disposed on the upper shell 40A or 40B;

58 is a fastening means disposed on lower shell 50A or 50B;

60 is a strap with fastening means disposed on at least on one side thereof;

62 is a optional lip portion;

64 is a ventilation hole; and 66 is a hinge for affixing the upper and lower shell members.

DETAILED DESCRIPTION OF THE DRAWINGS

Figure 1A:
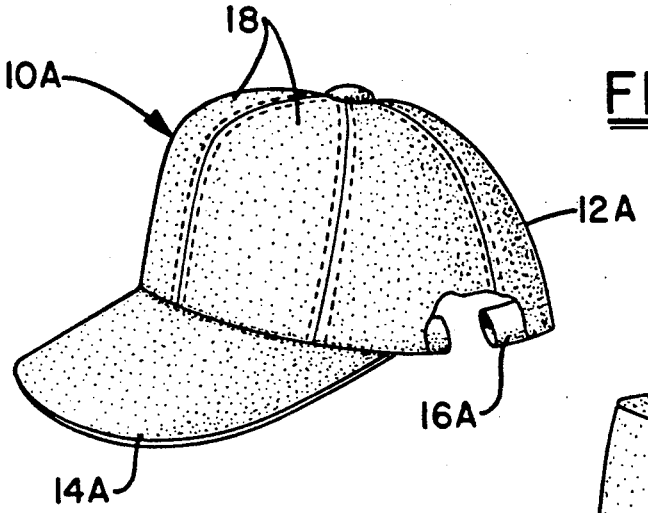
FIG.-1A Prior Art
FIG. 1A shows a perspective view of the common "dome"-type baseball cap of the prior art, with a partial cutaway to reveal internal detail.
Figure 1B:
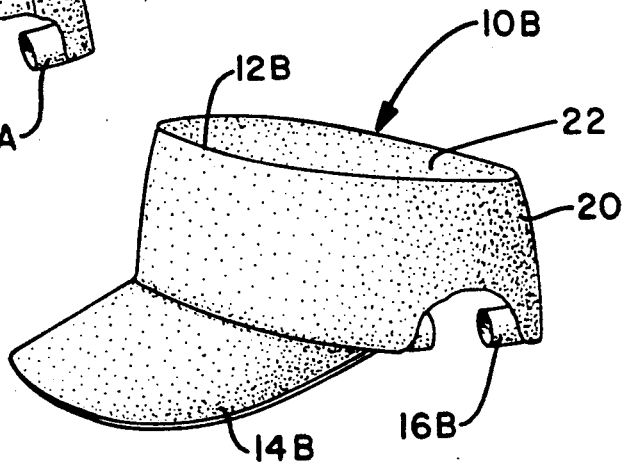
FIG.-1B Prior Art
FIG. 1B shows a perspective view of the common "pillbox"-type baseball cap of the prior art, also with a partial cutaway.

FIG. 1A and 1B illustrate the two general types of visored baseball caps that are commonly manufactured. FIG. 1A illustrates the "dome"-shaped cap 10A that is most commonly worn by baseball players. Such a cap 10A comprises a dome-shaped crown portion 12A, a visor or bill portion 14A that is placed along the periphery of the crown portion 12A and generally extending forwardly from the crown portion, and a band portion 16A, generally placed around the inside periphery of the crown portion.

The crown portion 12A of the dome-shaped cap 10A generally comprises a plurality, generally four to six essentially triangular shaped pieces 18 of material, such pieces sewed along two sides to the adjacent triangular shaped pieces so that the apexes of the triangles generally meet in the center top portion or apex of the crown. Some tapering is added to the triangular portions 18 so that the rounded crown portion 12A is obtained. Commonly, a cloth-covered button 19 is sewed onto the apex of the crown portion at the point where the triangular shaped pieces 18 are joined.

An alternate type of baseball cap is the "pillbox" type cap 10B that was popular during the 1890's and still has occasional popularity with some teams. In this shape of cap, the parts are identical with the dome shaped cap 10A, with the exception that instead of a plurality of triangular shaped pieces 18 forming a dome shaped crown portion 12A, the crown portion 12B thereof generally comprises an essentially vertical piece of material 20 joined upon itself to circumscribe the periphery of the wearer's head and an essentially circular piece of material 22 joined along the edge of the material piece 20 opposite the edge that circumscribes the wearer's head, the circular piece of material 22 being joined to the vertical piece 20 in a essentially perpendicular manner.

In either case, the caps 10A or 10B have little in the way of reinforcing material internal to the crown portion 12A or 12B and the reinforcing material in the visor portion 14A or 14B, which is typically covered with similar cloth to that used in the crown portion 12A or 12B, is deformable and generally permanently deformable.

Figure 2A:
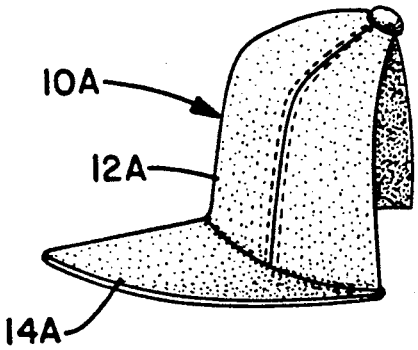
FIG. 2A shows a perspective view of a compactly folded common "dome"-type baseball cap.
Figure 2B:
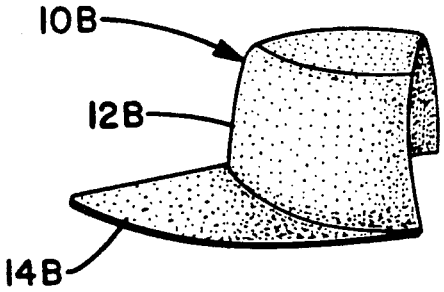
FIG. 2B shows a perspective view of a compactly folded "pillbox"-type baseball cap.

It is well known that the forward half and the rear half of the crown portion 12A or 12B of the baseball cap, either in the dome or in the pillbox configuration, are symmetrically similar to each other, so that the rear half of the crown portion of the cap may be folded into the forward half of the crown portion, as is illustrated in FIGS. 2A and 2B. It is in this manner that baseball caps are generally stacked upon each other in boxes after their manufacture and prior to their delivery to the ultimate wearer. In such a stacking arrangement, the presence of a plurality of caps with each other tends to provide support to the other respective caps, and the first and last caps in the stack indeed provide some modicum of protection from the elements to the intermediate caps. Once the caps are distributed to individual players, however, and used in games, such a convenient stacking arrangement is not generally available, since the caps tend to become soiled with moisture, dirt, etc. and because the players are assigned the responsibility for caring for their own cap.

As is clear from FIGS. 1A, 1B, 2A and 2b, as well as FIGS. 3A and 3B, 5A, 5B and 6A and 6B, a large number of features of the present invention are common whether the cap for which it is used is the dome-shaped cap of FIG. 1A or the pillbox-shaped cap 10B of FIG. 1B. Therefore, in describing the features in FIGS. 3A, 5A and 6A, similar description can be understood to apply to the corresponding numbers in FIGS. 3B, 5B and 6B for use with the embodiment of the invention adapted to fit the pillbox shaped cap 10B. Any distinctly different features due to the differences between the cap 10A and 10B will be clearly pointed out.

The upper shell portion 40A of the present invention is disclosed in FIG. 3A, which is a top view of the upper shell. This piece is structurally similar in shape to the forward half of the crown portion 12A of the cap 10A and has a similar visor 44A attached to its forward portion 42A. Because it is intended that the cap 10A fit inside the inner surface of the visor portion 44A and the dome portion 42A, the first piece 40A is sized to be slightly larger than the cap 10A that it will accommodate.

Figure 4:
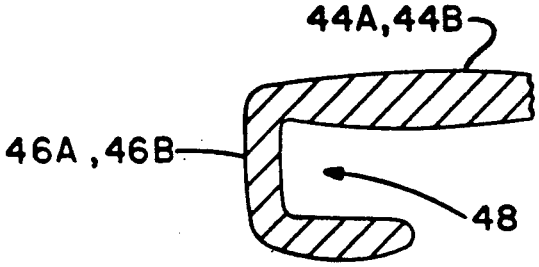
FIG. 4 shows a cross-sectional view of the front portion of the visor of the upper shell of the present invention.
Figure 7A:
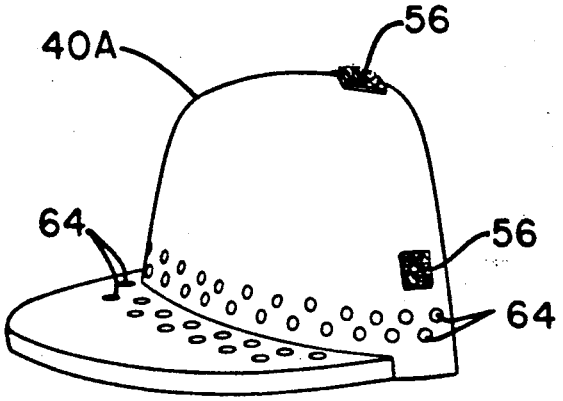
FIG. 7A discloses placement of fastening means and ventilation means on the upper shell of the present invention, as adapted for a "dome"-type baseball cap.
Figure 7B:
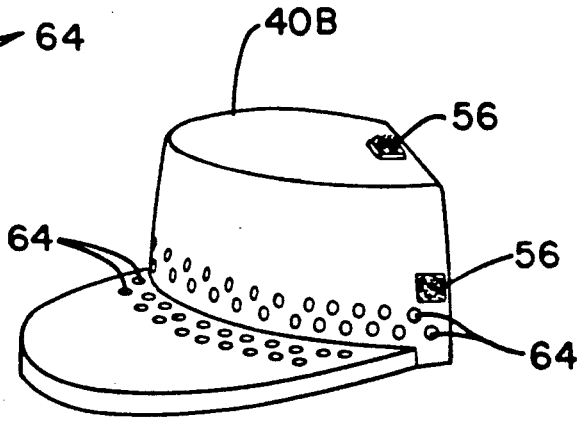
FIG. 7B shows placement of fastening means and an alternate ventilation means on the upper shell of the present invention, as adapted for use with the "pillbox"-type baseball cap.

FIG. 4A illustrates the forward portion 44A of the bill or visor of the upper shell 40A of the present invention. It is noted that the forward portion of the visor 44A has a nesting means disposed on the lower surface thereof. In the particular embodiment shown in the figure, this nesting means comprises a lip portion 46A that extends generally downward from the lower surface of the visor for a short distance and then turns inwardly towards the dome shaped portion of the shell. This nesting structure provides a slot 48 into which the bill 14A of the cap 10A to be protected may be slid.

FIG. 5A illustrates the lower shell 50A of the present invention. Because this portion is intended to rest generally under the cap 10A that will be protected, rather than atop it, this lower shell 50A is generally smaller than the upper shell 40A. Also, there is no nesting means disposed on the lower surface of the visor portion 54A, as the visor portion 54A of the lower shell 50A is intended to slide into the slot 48 provided by the nesting means provided on the upper shell 40A, thereby effecting a relatively close fit.

When the upper shell 40A, a cap 10A to be protected, and the lower shell 50A are engaged as described, the result is generally as shown in FIG. 6A. This figure also shows a fastening means disposed on the upper surface of the upper shell 40A and the lower surface of the lower shell 50A so that the upper and lower shells 40A and 50A, respectively, may be secured together to hold the cap 10A in place. One typical method of making this fastening would be to place a small section of hook material 56 on the respective shell portions and to engage such hook pieces 56 with a small strap 60 having "loop" material disposed on at least one side thereof. If only one such hook and loop fastening means is placed on the shell, it will typically be at the top of the crown portion of the shell, although it would be obvious how to position further fastening means if this is desired.

The upper and lower shells 40A amd 50A, respectively, are preferably manufactured from a rigid plastic material, preferably a polyurethane, polypropylene or poylycarbonate material, and even more preferably, a transparent or translucent rigid plastic material, so that the cap 10A may show through the protective shell. Selection of the thickness of the plastic material for the shell pieces 40A and 50A or 40B and 50B will certainly depend upon the inherent rigidity of the material used, although it would be expected that the thickness would certainly be less than one-quarter inch and probably less than one-eighth inch.

Many variations on the above construction will be obvious to one of skill in the art. For example, the preferred protective shell of the present invention will have a plurality of ventilation holes 64 provided in both the upper and lower shell portions 40A and 50A such that air may circulate to the cap 10A contained within the holder. The most preferred position for such holes 64 will be in the area of the shell located adjacent to the periphery of the crown portion 12A of the cap and along the bill portion 14A of the cap, again closely positioned towards the attachment to the crown. Such holes 64 may be regular or irregular in size and a typical range for the hole size will be from about one-eighth to about three-eighths of an inch in diameter.

A further optional feature illustrated in FIG. 6B, but clearly applicable to the analogous position in FIG. 6A, is at the top crown portion of the upper shell 40B, which is angled downwardly to provide an additional lip 62 for protecting the cap at the interface between upper shell 40B and lower shell 50B. In this manner, a closer fit of the cap within the shell may be obtained.

Figure 8:
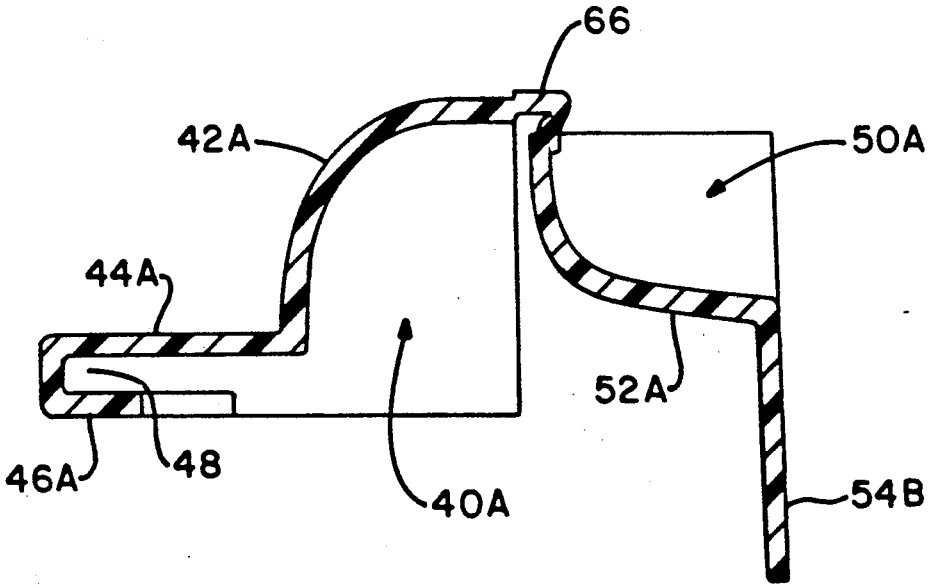
FIG. 8 shows an additional embodiment of the present invention, illustrating the placement of a hinge as a fastening means on the shell portions.

FIG. 8 is provided to illustrate a further method of fastening the respective crown portions 42A and 52A or 42B and 52B of the shell members together. Some moldable plastic materials, notably polypropylene, are known for their ability to form hinges or flexed surfaces that gain strength upon repeated flexes. It also may be desirable from a manufacturing standpoint to mold the upper and lower shell portions in a single molding step. Therefore, attaching the upper and lower shell portions by means of a hinge 66 molded integrally to each shell portion 40A and 50A, as shown in FIG. 8, which is a sectional view along the same line upon which FIG. 6 is taken, may be commercially desirable while still achieving the objectives of the invention. As stated earlier, the application of this concept to the invention for cap 10A is not limited to the cap 10A, but can be understood to be equally useful with the cap 10B, making the appropriate changes in part numbers.

While in accordance with the patent statutes the preferred and best embodiment of the invention are disclosed herein, it is obvious that other embodiments and modifications thereof are possible that fall within the teachings of the invention. The scope of the invention is not to be limited to the above description, but is instead to be measured by the appended claims.

What is claimed is:

1. A form retaining case for a cap, said cap having a crown portion with front and rear halves, and a visor portion affixed to the front half of said crown portion, said rear half of said crown portion being inwardly foldable to be proximate to said front half thereby forming first and second surfaces in such folded position, said protective case comprising:

a first shell member having a visor portion and a crown portion and first and second surfaces, said first shell member having its second surface sized and adapted to be slightly larger than, and to closely accommodate, the first surface of said cap when the crown portion of said cap is in said folded position;

a second shell member having a visor portion and crown portion and first and second surfaces, said second shell member having its first surface sized and adapted to be slightly smaller than, and to closely accomodate, the second surface of said cap when the crown portion of said cap is in said folded position;

at least one means for engaging the visor portion of said first shell member with the visor portion of said second shell member while the visor portion of said cap is juxtaposed between said the visor portions of said first and second shell members; and at least one means for fastening the crown portion of said first shell member to the crown portion of said second shell member when the crown portion of said cap is juxtaposed between the crown portions of said first and second shell members.

2. The form retaining case according to claim 1 wherein the crown portions of respective first and second shell members are shaped to accomodate a cap having a generally dome-shaped crown portion.

3. The form retaining case according to claim 1 wherein the crown portions of respective first and second shell members are shaped to accomodate a cap having a generally pillbox-shaped crown portion.

4. The form retaining cap according to claim 1 wherein the means for engaging said visor portions of said first and second shell members comprises a lip portion disposed on one surface of one said shell member, said lip portion providing a slot for inserting the visor portion of the other said shell member.

5. The form retaining case according to claim 1 wherein the means for fastening the crown portion of one said shell member to the crown portion of other said shell member comprises:

an elongated strip; and an engaging means having first and second components, said first and second components being non-permanently attachable to the other;

one such component affixed to each end portion of said strip and two corresponding components, one each affixed to the first surface of the first shell member and the second surface of the second shell member.

6. The form retaining case according to claim 5 wherein the said first attachable component is a hook material and said second attachable component is the corresponding loop material.

7. The form retaining case according to claim wherein the means for fastening the crown portion of one said shell member to the crown portion of the other said shell member comprises a hinge having first and second ends, the ends of said hinge affixed to the crown portion of the corresponding shell members.

8. The form retaining case according to claim 1 wherein the case is constructed of a sufficient thickess of a plastic material to be structurally rigid.

9. The form retaining case according to claim 8 wherein the case is constructed of a moldable polyurethane.

10. The form retaining case according to claim 8 wherein the case is constructed of a moldable polypropylene.

11. The form retaining case according to claim 8 wherein the case is constructed of a moldable polycarbonate.

12. The form retaining case according to claim 1 wherein the case further has a plurality of ventilation holes in said first and second shell members.

13. The form retaining case according to claim 12 wherein said ventilation holes are circular.

14. The form retaining case according to claim 12 wherein said ventilation holes are generally elongated slots.

15. The form retaining case according to claim 12 wherein the placement of the ventilation holes is concentrated in the area of the respective shell members where the visor portion attaches to the crown portion.

16. The form retaining case according to claim 1 wherein a protective lip sized to overlap the edge of the crown portion of one shell member is situated around the edge of the crown portion of the other shell member.

* * * * *